US005551449A

United States Patent [19]

Huang

[11] Patent Number: 5,551,449

[45] Date of Patent: Sep. 3, 1996

[54] CIGARETTE HOLDER HAVING CONTROL DEVICE

[76] Inventor: Chang-Shin Huang, No. 331, Sec 2, Yung Ping Road, Taichung, Taiwan

[21] Appl. No.: 492,239

[22] Filed: Jun. 19, 1995

[51] Int. Cl.[6] ..... A24F 5/04

[52] U.S. Cl. ..... 131/187; 131/215.1; 131/198.1

[58] Field of Search ..... 131/206, 175, 131/187, 215.1, 215.3, 198.1, 198.2, 338, 339

[56] References Cited

U.S. PATENT DOCUMENTS 3,174,487 3/1965 Missler ..... 131/187
3,713,452 1/1973 D'Elia et al. ..... 131/215.3
4,327,748 5/1982 Divis ..... 131/187

*Primary Examiner*—V. Millin
*Assistant Examiner*—Charles W. Anderson
*Attorney, Agent, or Firm*—Charles E. Esq. Baxley

[57] ABSTRACT

A cigarette holder includes a longitudinal passageway having one end for engaging with a cigarette and having a space formed in the middle portion. A pair of resilient blades are engaged in the space and each has a middle portion for blocking the passageway. The middle portions of the resilient blades are movable by being squeezed away from each other so as to open the passageway when the resilient blades are nibbled or gnawn by the users. A lateral hole is formed in the holder and communicated with the passageway so as to allow fresh air to flow into the passageway via the lateral hole.

3 Claims, 1 Drawing Sheet

CIGARETTE HOLDER HAVING CONTROL DEVICE

BACKGROUND OF THE INVENTION

1. Field of the Invention

The present invention relates to a holder, and more particularly to a cigarette holder having a control device for controlling flow of the smoke.

2. Description of the Prior Art

Typical cigarette holders comprise a holder body having one end for engaging with the cigarette and having a passageway formed therein for sucking the smoke generated by the cigarette. As far as the applicant is aware, no control device has been provided for controlling flow of the smoke.

The present invention has arisen to mitigate and/or obviate the afore-described disadvantages of the conventional cigarette holders.

SUMMARY OF THE INVENTION

The primary objective of the present invention is to provide a cigarette holder which includes a control device for controlling flow of the smoke.

In accordance with one aspect of the invention, there is provided a cigarette holder comprising a body including a passageway formed longitudinally therein and including a first end having a cavity formed therein and communicating with the passageway, and including a second end, the passageway including an opening formed in the second end of the body, the body including a middle portion having a space formed therein and intersecting the passageway, and a pair of resilient blades engaged in the space and each including a middle portion for blocking the passageway. The middle portions of the resilient blades are moved away from each other so as to open the passageway when the body and the resilient blades are nibbled or gnawn by the users.

The body includes a lateral hole formed between the space and the opening of the passageway, the lateral hole is communicated with the passageway so as to allow fresh air flowing into the passageway via the lateral hole.

The middle portion of the body includes an orifice formed therein and communicating with the space for engaging the resilient blades into the space.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
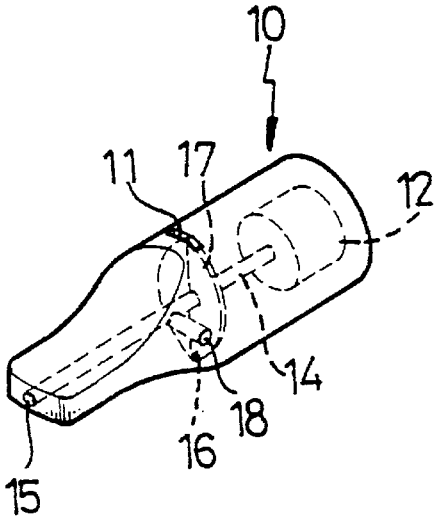
FIG. 1 is a perspective view of a cigarette holder in accordance with the present invention.
Figure 2:
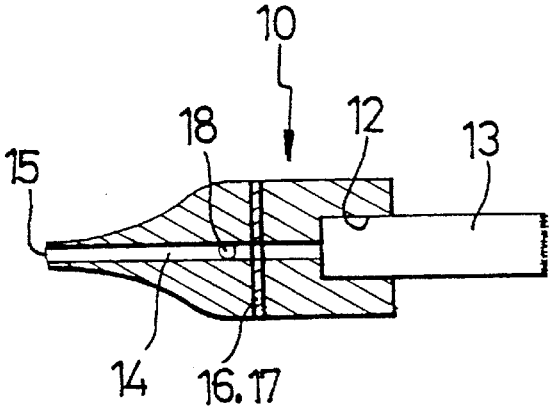
FIG. 2 is a longitudinal cross sectional view of FIG. 1.
Figure 3:
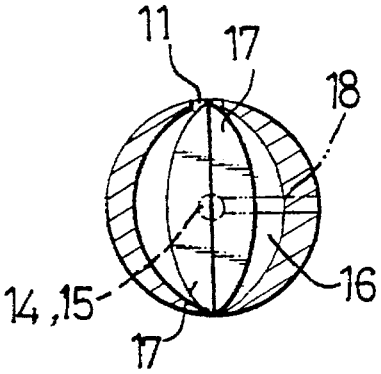
FIGS. 3 and 4 are transverse cross sectional views of FIG. 1.

Referring to the drawings, and initially to FIGS. 1 to 3, a cigarette holder in accordance with the present invention comprises a body 10 preferably made of resilient materials and including a cavity 12 formed in one end for engaging with a cigarette 13 and including a passageway 14 formed longitudinally therein and communicating with the cavity 12. The passageway 14 includes an opening 15 formed in the other end of the body 10 for sucking the smoke generated by the cigarette. The body 10 includes a space 16 formed in the middle portion and intersected with the passageway 14, and includes an orifice 11 for engaging a pair of resilient blades 17 into the space 16. The resilient blades 17 may block the passageway 14, best shown in FIG. 3, so as to prevent the smoke from flowing through the passageway 14.

Figure 4:
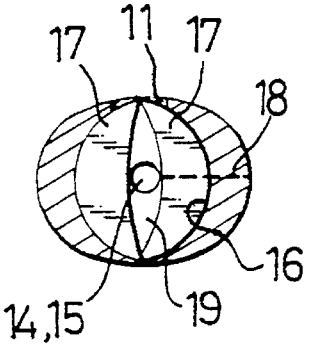

Referring next to FIG. 4, when the body 10 is squeezed, usually by being nibbled or gnawn by the mouth of the user, the blades 17 may be forced to deform and the middle portions thereof will be forced to move away from each other so as to form a gap 19 therebetween such that the passageway 14 is opened and is not blocked and such that the smoke is allowed to flow through the passageway 14.

A lateral hole 18 is formed in the body 10 and located between the opening 15 and the blades 17 and communicated with the passageway 14. When the passageway 14 is blocked by the blades 17, fresh air may be drawn into the mouth of the user via the lateral hole 18 and the opening 15. However, as shown in FIG. 4, when the body 10 is squeezed, usually by being nibbled or gnawn by the users, the lateral hole 18 may be closed or blocked such that fresh air is prevented from entering into the passageway 14 via the lateral hole 18.

Thus, the cigarette holder in accordance with the present invention includes a control device for controlling flow of the smoke.

Although this invention has been described with a certain degree of particularity, it is to be understood that the present disclosure has been made by way of example only and that numerous changes in the detailed construction and the combination and arrangement of parts may be resorted to without departing from a spirit and scope of the invention as hereinafter claimed.

I claim:

1. A cigarette holder comprising:

a body including a passageway longitudinally formed therein and including a first end having a cavity formed therein for engaging with a cigarette and communicating with said passageway, and the body including a second end, said passageway including an opening formed in said second end of said body, said body including a middle portion having a space formed therein and intersecting said passageway, and a pair of resilient blades mounted in said space, each of the blades including a middle portion movable by being alternately squeezed and relaxed between a closed condition wherein it cooperates with the other blade to block said passageway and an open condition wherein it is spaced from the other blade to open said passageway.

2. A cigarette holder according to claim 1 wherein said body includes a lateral hole formed between said space and said opening of said passageway, said lateral hole is communicated with said passageway so as to allow fresh air flowing into said passageway via said lateral hole.

3. A cigarette holder according to claim 1 wherein said middle portion of said body includes an orifice formed therein and communicating with said space for engaging said resilient blades into said space.

* * * * *